US005244732A

United States Patent [19]

Brandon et al.

[11] Patent Number: 5,244,732

[45] Date of Patent: Sep. 14, 1993

[54] CROSSLINKED RESINS USEFUL IN PHENOLIC RESIN CONTAINING FIBERS

[75] Inventors: Richard L. Brandon, Chillicothe; Alexander R. Pokora, Pickerington, both of Ohio

[73] Assignee: The Mead Corporation, Dayton, Ohio

[21] Appl. No.: 701,121

[22] Filed: May 16, 1991

Related U.S. Application Data

[63] Continuation-in-part of Ser. No. 589,867, Sep. 28, 1990, abandoned.

[51] Int. Cl.[5] ..... B32B 27/02; D02G 3/00

[52] U.S. Cl. ..... 428/375; 428/378; 428/394

[58] Field of Search ..... 428/361, 373, 375, 378, 428/392, 394, 395; 528/210, 211

[56] References Cited

U.S. PATENT DOCUMENTS

| | | | |
|---|---|---|---|
| 3,770,494 | 11/1973 | Shichijo et al. | 428/394 |
| 4,022,755 | 5/1977 | Tanigaichi et al. | 525/504 |
| 4,060,657 | 11/1977 | Iwami et al. | 428/375 |
| 4,157,360 | 6/1979 | Prevorsek et al. | 428/379 X |
| 4,213,672 | 7/1980 | Aulich et al. | 350/96.23 |
| 4,230,766 | 10/1980 | Gaussens et al. | 428/288 |
| 4,536,448 | 8/1985 | Ogawa et al. | 428/394 |
| 4,831,086 | 5/1989 | Das et al. | 525/504 |

*Primary Examiner*—George F. Lesmes
*Assistant Examiner*—Christopher Brown
*Attorney, Agent, or Firm*—Thompson, Hine and Flory

[57] ABSTRACT

The present invention is directed to a fiber having improved chemical, thermal and structural stability, comprising an inner core material such as polyacrylonitrile of a first surface tension and an outer clad such as a cyanate ester of a polyphenol of a second surface tension lower than the first surface tension such that the outer layer material adheringly surrounds the inner core material and is crosslinkable therewith, and where, in a preferred embodiment, the polyacrylonitrile and the cyanate ester crosslink to form triazine; and a method and compound for the same; a novel crosslinked phenolic resin is also described.

2 Claims, No Drawings

CROSSLINKED RESINS USEFUL IN PHENOLIC RESIN CONTAINING FIBERS

CROSS REFERENCE TO RELATED APPLICATION

This is a continuation-in-part of Ser. No. 589,867 filed Sep. 28, 1990, now abandoned.

BACKGROUND OF THE INVENTION

1. Field of the Invention

The present invention relates generally to fibers formed of an inner core material of a first surface tension and an outer clad material of a second surface tension wherein the outer layer material adheringly surrounds the inner core material, and a method for producing the same.

The present invention is also directed to a compound formed by crosslinking the polyacrylonitrile and cyanate ester of the polyphenol of formula (I) and to uses of this crosslinked product in other composites.

2. Brief Discussion of Prior Art

Previous methods have been employed to form fibers from novolaks. Novolak fibers are generally used in fire retarding materials such as fireproof clothing, vehicle seating, blankets, electrical coverings, paints, vehicles, packaging, wastewater treatment and purification systems. Although a novolak fiber is thermally stable, the fibers have low structural stability.

Many methods for forming novolak resin fibers are known in the art. In one method, fibers are formed by melting a novolak and forming it into a fiber. A fiber is formed in a vessel having a heating element for heating the novolak within the vessel and an orifice at its bottom through which the novolak resin flows. To form the fiber, the novolak is placed within the vessel, the vessel is heated to a temperature sufficient to melt the novolak and maintain the novolak in the molten state, the molten novolak flows out of the orifice of the vessel and upon contacting the atmosphere and cooling, is wound upon a spool. Other known methods may be employed to form a novolak fiber. For example, the melted novolak may be extruded under pressure while being drawn and filtered under pressure to remove any solid impurities thereby improving the quality of the fibers. Optionally and instead of drawing, a blowing method can be employed such that the melted novolak is allowed to drop in a thin stream into a path of a blast of air which fiberizes the stream.

A general discussion of novaloid fiber forming techniques is found in Chemtech, July, 1989, p. 424. A discussion of pultrusion and melt spinning is available in Text Book of Polymer Science, 3rd, Chapters 17 and 18, John Wiley and Sons, 1984. Jetting technique is described in C. H. Hertz, Fluid Mech., Vol. 131, pp. 271-87 (1983).

The process of hardening or curing the fibers is very cumbersome. The curing mechanism generally involves the diffusion of formaldehyde into the fiber and reaction of the novolak and formaldehyde to bring about crosslinking of the novolak molecules. The curing process involves exposing the fibers to formaldehyde or other aldehydes in the presence of an acid or base catalyst. The fibers are exposed in one method by passing through an aqueous solution or by vapors these materials. Further, extensive washing of the fibers is often required to remove the acid. Furthermore, these traditional techniques have resulted in undesirable biproducts as in the case with formaldehyde or epoxy derivatives.

A major problem with the novolak fibers discussed above is that they are weak and brittle, although thermally stable. Blends or crosslinked fibers have been made from novolaks and a flammable but structurally stable fiber material to improve their strength. However, the problem of thermal instability arises because the flammable fiber component remains exposed to the atmosphere.

Side-by-side spinning techniques have been employed using phenolic resins in combination with a heat-meltable resin to form a fiber as described in U.S. Pat. No. 3,996,327. This technique has a drawback in that when the amount of the heat-meltable resin is increased, the mechanical strength increases, however, chemical and thermal stability decrease. Furthermore, side-by-side spinning does not result in crosslinking the heat-meltable fiber with the phenolic resin

DEFINITIONS

The term "novolak" refers to a condensation product of phenolic compound with formaldehyde, the condensation being carried out in the presence of an acid catalyst to form a resin, wherein there are virtually no methylol groups such as are present in resoles and wherein the molecules of the phenolic compound are linked together by way of a methylene group. The phenolic compounds previously employed are typically a phenol wherein one or more of the non-hydroxylic hydrogens are replaced by any of various substituents attached to the benzene ring, for example, phenylphenols, cresols, chlorophenols, and the like. Alternatively, a naphthol or a hydroxyphenanthrene could be used instead of the phenol.

The surface tension in any liquid is the attractive force exerted by the molecules below the surface upon those at the interface. In other words, molecules at the interface experience a net attractive force toward the interior. There exists an inward pull, or cohesiveness, which is created and tends to restrain the liquid from dispersing. A liquid's cohesiveness varies with the chemical nature of the liquid. Polar liquids have high surface tension (e.g., water=73 dynes/cm at 20° C.); nonpolar liquids have much lower values (e.g., benzene=29 dynes/cm, ethanol=22.3 dynes/cm), thus they flow more readily than water.

SUMMARY OF THE INVENTION

The present invention relates to a thermally and mechanically stable fiber comprising an inner core material having a first surface tension for providing structural stability and an outer clad material having a second surface tension for providing thermal stability and wherein the second surface tension is lower than the first surface tension.

The surface tension relationship is important for the following reasons.

One method of making the fiber comprises the step of moving an inner core material of a first surface tension through an outer core material of a second surface tension different from the first surface tension such that the outer layer material adheringly surrounds the inner core material and wherein substantially no intermixing of the inner core material and outer layer material occurs. Preferred methods of forming the material further characterize the step of moving to be either jetting, extruding, pultruding or flowing.

When using two liquid materials having different surface tensions it is necessary in order to prevent intermixing of the liquid materials. If the surface tensions of the two liquid materials are too close (e.g., 1:1) the materials will have substantially similar cohesiveness. As the inner core material moves through the outer layer material, the inner core material may be dispersed by the outer layer material resulting in intermixing of the materials. This can be undersirable when forming a fiber wherein the inner core material is not as resistant to exposure of heat, for example, as the outer clad material. When the inner core material has a surface tension greater than that of the outer clad material, the inner core material remains columnated as it moves through the outer clad material.

It is possible to use materials having similar surface tensions, however, one of the materials must be in solid form and the other in liquid form. In such a case, a solid inner core material could be pultruded or extruded through the liquid outer layer material to form a fiber.

While it is desirable that the two materials be of different surface tensions, it is also desirable that the differences in the surface tensions not be too extreme. If, for example, the inner core material to outer layer material surface tension ratio is greater than 5 to 1, the outer layer material may tend to be less adhesive to the inner core material resulting in little or partial outer layer material covering the inner core material as the fiber is formed.

The inner core and outer clad material may contain a solvent or additives to depress the melting point and provide the proper surface tension. For example, such additives include hydrocarbon waxes, polyester plasticizers, high molecular weight alcohols and chlorinated hydrocarbons.

A preferred embodiment of the present invention resides in a fiber having an inner core material comprising polyacrylonitrile and an outer clad material comprising a phenolic resin of the formula (I)

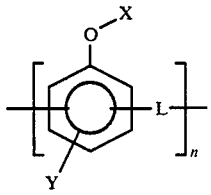

(I)

wherein y may be the same or different and is selected from the group consisting of a hydrogen atom, a halogen atom, an alkyl group, an alkoxy group, a phenylalkyl group, a phenyl group and an allyl group; x may be the same or different and is selected from the group consisting of a hydrogen atom and a cyano group or from the group consisting of a hydrogen atom and a glycidyl group; L is a direct bond or a methylene bridge; and n is greater than or equal to 2. The cyanate ester is preferably crosslinked via reaction with an acrylonitrile polymer as described herein. The number of cyano or glycidyl groups in the resin of formula I must be at least 2. It will vary with the number of hydroxyl groups in the resin from which the resin of formula (I) is prepared and the degree of substitution which is achieved.

In a particularly preferred embodiment of the present invention, the fiber comprises an inner core material made of polyacrylonitrile and an outer layer material made of cyanate ester of polyphenol, wherein the polyacrylonitrile and the cyanate ester of the polyphenol crosslink to form a triazine.

This reaction can be shown as:

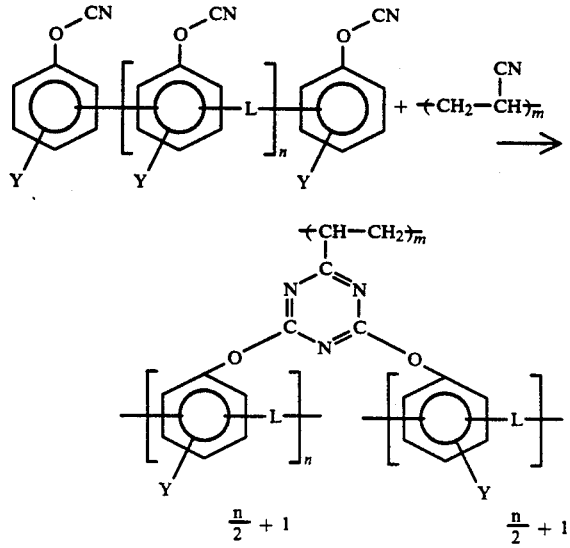

wherein y may be the same or different and is selected from the group consisting of a hydrogen atom, an alkyl group, an alkoxy group, a phenyl group, a phenylalkyl group, and an allyl group; L is a direct bond or a methylene bridge, m is about 800 to 1200; and n is 0 to about 30. It is preferred that n be greater than 0.

It is an object of the present invention to provide a fiber which has improved chemical and thermal stability while retaining structural stability.

It is another object of the present invention to provide an improved method for forming fibers wherein the method allows for the formation of a stronger and more thermally and chemically resistant fiber.

It is a further object of the present invention to provide a crosslinked resin which results upon crosslinking an acrylonitrile polymer with a cyanate ester of a phenol wherein the resin is characterized by the repeating unit represented by the formula (II)

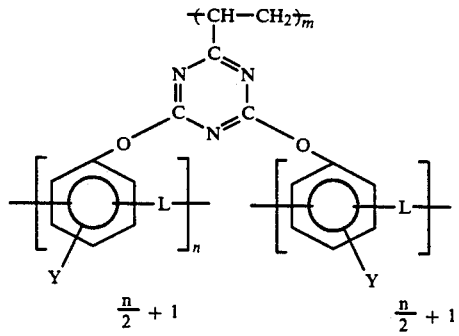

(II)

where y may be the same or different and is selected from the group consisting essentially of a hydrogen atom, a halogen atom, an alkyl group, an alkoxy group, a phenyl group, a phenyl-alkyl group, and an allyl group; and L is a direct bond or a methylene bridge. The free bonds shown in formula (II) may be from the ortho or para position or a combination. The compound of the formula (II) is excellent for use in fibers, however, it is within the scope of this invention that the present invention may also be employed in composites or other structures and that the present invention is not limited to use in fibers. For example, fibers of cyanate esters of phenolic resins may be incorporated into a matrix of polyacrylonitrile and crosslinked as described herein or fibers of acrylonitrile polymers may be incorporated into a matrix of a cyanated phenolic resin.

In a further embodiment of the invention a glycidylated resin is used in place of the cyanated resin described above.

DETAILED DESCRIPTION OF THE PREFERRED EMBODIMENTS

As indicated at the outset, various methods for making clad fibers known in the art may be used to make the fibers of the invention. Such methods include coextrusion and drawing a first solid fiber through a bath or curtain of a second fiber, pultrusion, etc.

In certain embodiments, fibers of the present invention may be prepared by moving an inner core material having a first surface tension through an outer clad material of a second surface tension lower than the first surface tension such that the outer clad material adheringly surrounds the inner core material. It is important that substantially no intermixing occur as the inner core material moves through the outer clad material. The inner core material and the outer clad material can be, and preferably are, crosslinkable polymers.

In this embodiment, the inner core material preferably has a surface tension greater than the surface tension of the outer clad material. When the materials are both liquids, the ratio of the surface tensions of inner core to outer clad preferably does not exceed 5:1, and is more preferably less than 4:1. The exact surface tensions are not known because the inner core and outer clad material are only in liquid molten form during the fiber formation process and empirical measurement of the surface tensions is difficult. The difference in surface tension is not essential if the core resin is pre-formed into a fiber and drawn through the clad material in a manner known in the art.

In one embodiment, the fiber may be formed by supplying into a heated vessel an outer clad material having a particular surface tension, the vessel having an orifice through which a fiber may be formed, and an aperture communicable with that orifice. An inner core material having a surface tension different from outer layer material may be extruded through the orifice in a manner such that the inner core material contacts the outer clad material and the outer clad material adheringly surrounds the inner core material with substantially no intermixing of inner core material and outer clad material.

Upon exiting the orifice, the composite fiber is heated to a first temperature in the range of from about 50° to about 200° C. in order to crosslink the outer clad material. The fiber then may be, and preferably is, heated to a second temperature in the range of from about 150° to about 300° C. such that inner core material and outer clad material are crosslinked to form a mechanically strong and thermally and chemically stable fiber, provided that the second temperature is higher than the first temperature.

Upon exiting the orifice and having been heated to a temperature which causes crosslinking between the inner core material and outer clad material, the fiber can undergo pyrolysis (tee transformation of a crosslinked carbon fiber to a graphite fiber upon extreme heat). Temperatures of about in excess of 1000° C. are required for pyrolysis. The fiber is preferably post-treated at 1500° C. to 2000° C.

In another embodiment, a liquid inner core material of a first surface tension may be jetted through a liquid outer layer material of a second surface tension different from the first surface tension, wherein the liquid inner core material is in the form of a stream or column through the outer layer material. It is believed that the differences in surface tension and molecular weight of the materials chosen allow the inner core material to remain cohesively bonded and columnated. Theoretically, under the proper temperature, a liquid inner core material of one surface tension will flow through a liquid outer layer material of a different surface tension such that the fiber forms with the outer layer material adheringly coated about the inner core material. Alternatively, a solid inner core material may be pultruded through a liquid outer layer material.

The strength, rigidity, heat or chemical or electrical resistance which is desired in the fiber is a direct function of the composition of the fiber and the degree and nature of crosslinking. If high flexibility is desired, the inner core and outer layer materials should be crosslinked to a lesser degree than if high strength and resistance are desired.

The outer clad materials may consist of polyphenolic resins prepared as described in U.S. application Ser. No. 07/507,552, filed Apr. 9, 1990, abandoned, which is incorporated herein by reference. Particularly preferred is the cyanate ester of the polyphenolic resin having a molecular weight from about 500 to 3,000. Other suitable polymer precursors such as epoxides and vinyl esters are suitable for an outer clad material. The outer clad material may also be a polyphenol as produced by the process as described in U.S. Pat. No. 4,900,671 and, more preferably, a cyanate ester thereof. These polyphenols are particularly advantageous because they do not include methylene bridges in the polymer chain and this enhances the thermal stability of the polymer. On the other hand, while conventional novolaks do not enjoy all the benefits of these methylene-bridge free polymers, they also can be used in this process.

The inner core material is preferably polyacrylonitrile. Fiber-forming polyacrylonitriles are known in the art. Polyacrylonitrile provides good tensile strength but its elasticity is poor. Nylon polyvinyl acetate, polyvinyl chloride, polyesters and polyethylenes or mixtures thereof would also make suitable inner core materials. Acrylonitrile copolymers may also be used such as copolymers of acrylonitrile and up to 30% styrene or methyl methacrylate.

A particularly preferred combination of materials for the fiber of the present invention includes the outer layer comprised of cyanate ester of polyphenol and an inner core material of polyacrylonitrile. These polymers crosslink with formation of a triazine ring to provide improved strength as well as thermal and chemical stability.

While it is not the preferred fiber composition or method for making the fiber, the inner core material can include phenolic polymer and suitable catalysts. In such case, the outer layer material can include polyacrylonitrile, nylon, etc.

Catalysts such as metal naphthenates and in particular zinc naphthenate are useful in crosslinking the cyanate esters. Suitable catalysts for other outer layers are imidazoles, dicyandiamide or substituted amines such as triethylamine for epoxides and sodium hydroxide or hydrochloric acid for the phenolic resins cured with formaldehyde. Bisoxazoles and bisoxazolines, can be added to polyphenols as catalysts without producing volatile products, however, these materials require that the temperature be kept closely monitored to prevent premature crosslinking. The catalysts used herein should be dissolved in the resin.

The polyphenols of the present invention can be a novolac, resole or the enzyme catalyzed polymers described in U.S. Pat. No. 4,647,952. Such polyphenols can be crosslinked in the conventional manner in which the fiber is contacted with formaldehyde at high temperature in the presence of an acid catalyst such as hydrogen chloride. Alternatively, a glycidyl derivative of the polyphenol may be crosslinked in a known manner with typical epoxy crosslinking agents such as polyamines and polyphenols. As previously mentioned, these materials are not preferred due to the volatile side products. The amount of crosslinker will depend on the degree of crosslinking which is desired. The reaction proceeds readily at room or elevated temperatures and pressures.

The preferred embodiment which includes the cyanate ester derivative of the polyphenol may be prepared from polyphenols using synthetic approaches described in U.S. application Ser. No. 507,552, abandoned, and U.S. Pat. No. 4,831,086 to Das et al. The cyanate ester derivative of the polyphenol of the present invention may be converted into crosslinked phenolic triazines upon heating as discussed in U.S. Pat. No. 4,831,086.

The inner core material may consist of any of the following materials which may be used as a reinforcing agent and/or crosslinkable polymer with the outer layer material: glass fibers; carbon fibers; plant fibers such as cotton and silk fibers; synthetic fibers such as aramid, nylon, rayon and olefinic fibers; polyacrylonitrile, polyesters, polyvinyl chloride, and polyethylene; and inorganic fibers such as fiberglass and asbestos.

Polymer blends can also be used in the core or clad. For example, blends of polyesters and polyacrylonitrile, polyethylene, or polyvinyl chloride may be used. Any combination of percentages of these materials may be used to make up the fiber material. However, it is preferred that the outer clad material contain at least 25 to 75 percent of crosslinkable polymer material.

Examples are set forth below to illustrate the nature of the invention and method of carrying it out. The example set forth below is not to be limiting to the details thereof.

EXAMPLE 1 (HYPOTHETICAL)

An acrylonitrile monofilament fiber can be passed through a bath containing the liquid cyanate ester of a polyphenol and subsequently through an oven heated to 100° C. As the fiber emerges from the bath, coated with the cyanate ester, the fiber passes through the aforesaid oven where the temperature is raised to 100° C. in order to begin the crosslinking process. When the crosslinking has proceeded to the extent that the integrity of the fiber can be maintained at high temperature the fiber is post cured at 105° to 200° C. The cured fiber is then ready for use for applications of typical phenolic fibers.

EXAMPLE

The fibers produced as described in Example 1 can be further processed to form superior carbon or graphite fibers. To form carbon fibers the crosslinking process of Example 1 is performed with the fibers in slight tension followed by pyrolysis in an inert atmosphere at 1000° C. The carbon fiber is then post-treated at 1500° C. to 2000° C. in an inert atmosphere to convert the carbon to a graphite fiber.

Having described the invention in detail and by reference to preferred embodiments thereof, it will be apparent that modifications and variations are possible without departing from the scope of the invention defined in the appended claims.

What is claimed is:

1. A fiber having improved chemical, thermal and structural stability comprising (a) an inner core material having a first surface tension for providing structural stability; and (b) an outer clad material having a second surface tension lower than said first surface tension for providing thermal stability such that said outer clad material adheringly surrounds said inner core material wherein said outer clad material is a polyphenol represented by the formula (I)

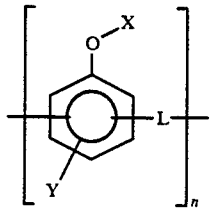

where y may be the same or different and is selected from the group consisting of a hydrogen atom, a halogen atom, an alkyl group, an alkoxy group, a phenylalkyl group, a phenyl group, and an allyl group; X is a cyanato group; L is a direct bond or a methylene bridge; and n is greater than or equal to 2; said inner core material being polyacrylonitrile; and said outer clad material is a material crosslinkable with said inner core material.

2. The fiber of claim 1 wherein said inner core material and said outer clad material are crosslinked to form a resin having a repeating unit of the formula (II) and n is 0 to 30

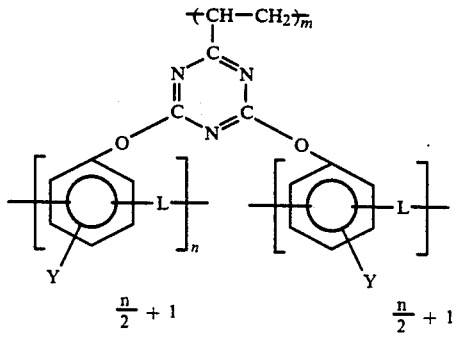

(II)

wherein L and y are defined as in claim 1.

* * * * *